United States Patent [19]

Katou

[11] Patent Number: 4,712,080

[45] Date of Patent: Dec. 8, 1987

[54] DEFLECTING YOKE

[75] Inventor: Akito Katou, Ashiya, Japan

[73] Assignee: Matsushita Electric Industrial Co., Ltd., Kadoma, Japan

[21] Appl. No.: 945,952

[22] Filed: Dec. 24, 1986

[30] Foreign Application Priority Data

Dec. 25, 1985 [JP] Japan ..... 60-201802[U]

[51] Int. Cl.[4] ..... H01F 5/02

[52] U.S. Cl. ..... 335/213; 335/210

[58] Field of Search ..... 335/210, 213; 313/421, 313/426

[56] References Cited

U.S. PATENT DOCUMENTS 4,359,705 11/1982 Bohn et al. ..... 335/213

4,378,544 3/1983 Yabase et al. ..... 335/213

4,484,166 11/1984 Osinga et al. ..... 335/213

*Primary Examiner*—George Harris

*Attorney, Agent, or Firm*—Cushman, Darby & Cushman

[57] ABSTRACT

In a deflecting yoke for a cathode ray tube having saddle-shape coils wound in slots extended along the inside of a coil form and in the coil head chambers of a rear bobbin and a front bobbin mounted to the coil form, either one of a horizontal deflection coil or a vertical deflection coil is wound prior to mounting of the rear bobbin and the front bobbin, and after mounting the rear bobbin and front bobbin on the coil form the remainder coil, namely, the vertical deflection coil or the horizontal deflection coil is wound thereon.

6 Claims, 12 Drawing Figures

DEFLECTING YOKE

FIELD OF THE INVENTION AND RELATED ART STATEMENT

1. Field of the Invention

The present invention relates generally to a deflecting yoke for a cathode-ray tube, and more particularly to a high precision deflecting yoke for a high resolution cathode-ray tube.

2. Description of the Related Art

The prior art high precision deflecting yoke of the U.S. Pat. No. 4,359,705 is shown in FIGS. 6, 7, 8, 9, 10 and 11.

FIG. 6 shows a cross-section view of a coil form 1 which has several slots 2 on its inside. In order to preserve the clarity of the drawing, only the slots on the upper half of the coil form are shown. Slots 2 are separated from one another by several ribs 3 which are shown shaded in the drawing. In this embodiment, coil form 1 is flared in the form of a horn so as to correspond to the shape of a CRT envelope. When the form is mounted on a CRT, ribs 3 thereof are in contact with the CRT envelope. As will be described below, vertical and horizontal deflection coils (not shown in this figure) are wound on the coil form so as to be disposed in slots 2. The coil form is provided with plural coil head chambers 4, 5, 6 and 7 which are formed from chamber walls 10, 11, 12, 13, 14 and 15. Wall 10 is shown in this embodiment to have a greater diameter than its associated chamber walls 15 and 14.

The figure shows two winding turns 8 and 9 which are associated with one each of the horizontal and vertical deflection coils, respectively. Turn 8 which is illustratively associated with one of two horizontal deflection coils extends out of the plane of the figure at chamber 7, runs along a longitudinal slot 2, and into the plane of the paper at coil chambers 4. The other turns (not shown) of the horizontal deflection coils are correspondingly disposed in associated slot 2. Turn 9 which is associated with one of two vertical deflection coils extends out of the plane of the paper at chamber 6, runs along a slot 2, and reenters the plane of the paper at chamber 5. It is apparent from the figure that turns 8 and 9 are equidistant from a longitudinal central axis (not specifically shown) of the coil form, and therefore the completed coils have substantially equal diameters.

FIG. 7 shows a frontal view of coil form 1, and shows the cross-section of section planes E and F along which the cross-sectional representation of FIG. 6 is presented. Longitudinal slots 2 are shown, and are provided with respective lower case letter designations which will facilitate the description, hereinbelow. The figure further shown the end faces of ribs 3 which merge into a front wall 11 of coil head chamber 7. Front wall 11 is shown to be discontinuous so as to permit communication between coil head chambers 7 and the slots 2. As can be seen from FIG. 6, predetermined ones of slots 2 which contain turns of wires to coil head chamber 7 run under chamber 6, and therefore do not communicate with chamber 6. However, other ones of slots 2 which carry wires to chamber 6, such as turn 9 in FIG. 6, may communicate with either chambers 6 or 7. Chamber 6 and 7 are separated from each other by a partition wall 12. Partition wall 12 is visible through some of the slots in FIG. 7. A chamber wall 13, which is shown in cross-section in FIG. 6, is also visible through other slots in FIG. 7.

FIG. 7 does not show any coil windings in order to preserve the clarity of the drawing. For purposes of illustration, however, a hypothetical coil turn (not shown) lying in slot 2*a* will run to a point 6*a* in front coil head chamber 6. At this point, the coil winding wire would be bent to the right at substantially a right angle, so as to be disposed in chamber 6 for approximately a semi-circle. The winding would enter slot 2*h* at a point 6*h*. In this example, the coil wire would run to the end of slot 2*h* and into rear coil head chamber 5, wherein it is returned to the rear of slot 2*a*. Such a winding will be shown in greater detail hereinbelow with respect to FIG. 9. Similarly, a corresponding winding can be formed by placing the wire in a slot 2*b* to a point 6*b*, at which point the wire is turned to the right so as to follow a semi-circle through coil head chamber 6 to a point 6*g* where the wire would enter slot 2*g*. The wire is returned to slot 2*b* by means of rear coil head chamber 5. Additional corresponding windings are disposed in slots 2*c*, 2*f*, 2*d* and 2*e*. All such windings are wound in series, and thereby form a vertical deflection coil. As previously indicated, the slots vary in depth with respect to one another so as to conform to the number of turns which they are expected to hold. A second vertical deflection coil (not shown) is symmetrical to the coil just described with respect to an axial plane VE which extends in the vertical direction. Both such symmetrical coils can be advantageously connected in series or parallel to form the set of coils for the vertical deflection.

In a fashion similar to that described hereinabove, horizontal deflection coils (not shown) are disposed on the coil form so as to be orthogonal to the vertical deflection coils and symmetrical with respect to an axial plane HE which extends in the direction of the horizontal deflection. Illustratively, one winding of the lower coil would lie in slots 2*i* and 2*j*. A further such winding would lie in slots 2*k* and 2*l*. In practice, the horizontal and vertical deflection coils are wound so as to be interleaved. The slots disposed between the axial planes VE and HE are alternatingly wound with horizontal and vertical deflection turns. Only those slots which are disposed adjacent to the axial planes VE and HE contain windings of coils associated with only one direction of deflection. Thus, the slots adjacent to axial plane VE contain only vertical deflection coil windings; and the slots adjacent to horizontal axial plane HE contain only horizontal deflection coil windings.

FIG. 8 shows a cross-section view through rear coil head chamber 4 taken along plane A—B of FIG. 6 and shows the rear coil of the upper horizontal deflection coil. For purposes of preserving the clarity of the drawing, the lower horizontal deflection coil is not shown. In this Prior Art, the shown upper horizontal deflection coil has its front coil heads disposed in front coil head chamber 7 (as shown in FIGS. 6 and 7). FIG. 8 shows a fragmented view of front wall 10 of coil head chamber 5. Since slots which communicate with chamber 5 are also in communication with chamber 4 and its walls 14 and 15 (see FIG. 6), chamber 5 is visible through the openings in wall 15. Accordingly, in this embodiment the vertical deflection coils must be wound prior to the winding of the horizontal deflection coils.

FIG. 9 shows a cross-section view along plane C—D of FIG. 6, and shows coil head chamber 5 and the left vertical deflection coil. The figure shows the continuity of the windings contained in slots 2*a* and 2*h*; 2*b* and 2*g*;

2c and 2f; and 2d and 2e. It is further visible from the drawing that the actual number of winding turns disposed in coil head chamber 5 varies over the circumference. Illustratively, more turns lie over slots 2c and 2d than over slots 2b and 2g. Such a variation in the number of turns over the circumference of the coil head chamber is compensated by providing a correspondingly varying depth.

FIG. 10 is a perspective view showing a configuration of the coil head chambers 4 and 5, and FIG. 11 is a side view thereof. Referring to FIG. 11, sectional view of a part of horizontal deflection coil 8 and the vertical deflection coil 9 are shown in enlarged size. When the wire of the vertical deflection coil 9 is wound, corner parts H of the respective wires tend to swell toward the chamber wall 15 than other parts. Hence some outer parts of the wires are liable to enter into slots 15*a* of the chamber wall 15 thereby to approach or to contact the horizontal deflection coil 8. Since a potential difference between the horizontal deflection coil 8 and the vertical deflection coil 9 may be such high as several kilovolts in operating state of the deflecting yoke, approach or contact of both the deflection coils results in dielectric breakdown of the deflection coils. And, sometimes, the deflection coils are liable to burn.

Furthermore, in winding process of the vertical deflection coil 9, the wire must be passed through both the slots 14*a* and 15*a*, for example, and therefore the winding process is complicated and troublesome.

Above-mentioned problems also encounter in the coil head chambers 6 and 7.

Additionally, many chamber walls 10, 11, 12, 13, 14 and 15 are disposed on both end of the coil form 1 and are molded in one piece. Consequently a complicated mold was required in the prior art to fabricate the coil form and a fabrication cost of the coil form was expensive.

OBJECT AND SUMMARY OF THE INVENTION

An object of the present invention is to provide a deflecting yoke wherein a vertical deflection coil and a horizontal deflection coil are completely isolated.

An other object of the present invention is to provide a deflecting yoke which is easy in winding of the vertical deflection coil and the horizontal deflection coil.

Further object of the present invention is to reduce a cost of a mold in a process of molding the coil form of the deflecting yoke by simplifying the configuration of the coil form.

A deflecting yoke in accordance with the present invention comprises:

a coil form for holding a horizontal deflection coil and a vertical deflection coil in plural slots extended along the inside of the coil form shaped so as to flare outwardly with respect to a direction along a central longitudinal axis, and having coil head chambers for winding one of the horizontal deflection coil and the vertical deflection coil, which are formed by walls disposed on both end parts of the slots, a rear bobbin for winding one of the horizontal deflection coil and the vertical deflection coil in a coil head chamber formed by two walls disposed around the rear bobbin having connecting means for connecting to the coil form, and a front bobbin connected to the coil form by connecting means for winding one of the horizontal deflection coil and the vertical deflection coil in a coil head chamber formed by two walls disposed around the front bobbin.

In accordance with the present invention, the coil head chambers 45 and 46 for the vertical deflection coils 29 are isolated from the coil head chambers 47 and 48 for the horizontal deflection coils 28 by the wall 23 and 25, respectively. Therefore, insulation between the vertical deflection coil and the horizontal deflection coil is completely maintained, and dielectric breakdown of the deflection coils are prevented.

The wires can be passed easily through only the slots provided on the walls 17 and 19, since the rear bobbin 21 and the front bobbin 22 are not yet mounted to the coil form 52. Hence, winding process can be simplified.

A frame of the deflection yoke consists of the coil form 52, the rear bobbin 21 and the front bobbin 22, and respective members are comparatively simple in their configuration. Therefore, the mold for fabricating the members are inexpensive.

DESCRIPTION OF THE PREFERRED EMBODIMENT

Figure 1:
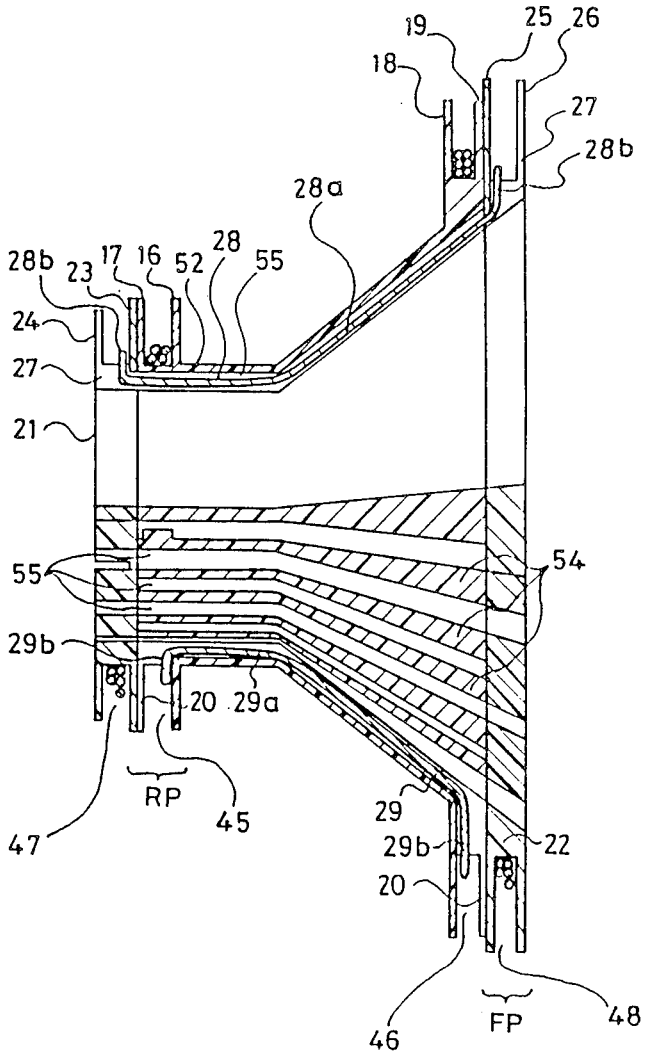
FIG. 1 is a cross sectional representation of an embodiment of a coil form in accordance with the present invention.

FIG. 1 shows a cross-section view of a coil form 52 which has several slots 55 on its inside. In order to preserve the clarity of the drawing, only the slots on the lower half of the coil form are shown. The coil form 52 is made of plastics such as polyphenyleneoxide. The coil form 52 is flared in the form of a horn so as to correspond to the shape of neck and cone part of a CRT envelope. Slots 55 are separated from one another by several ribs 54 which are shown shaded in the drawing. The coil form 52 is provided with two walls 16 and 17 on the rear portion RP and two walls 18 and 19 on the front portion FP, respectively. Slots 20 for passing winding wires are provided on the walls 17 and 19. A rear bobbin 21 is connected to the rear portion RP, and a front bobbin 22 is connected to the front portion FP of the coil form 52 by means of fasteners 33, 34, 37 and 38. The rear bobbin 21 and the front bobbin 22 are also made of plastics. When the coil form 52 is mounted on a CRT, the front portion FP is directed toward a phosphor screen of the CRT and the rear portion RP is directed toward an electron gun. A coil head chamber 45 is formed by the walls 16 and 17, a coil head chamber 46 is formed by the walls 18 and 19, a coil head chamber 47 is formed by the walls 23 and 24, and a coil head chamber 48 is formed by the walls 25 and 26. The walls 25 and 26 are shown in this embodiment to have a greater diameter than the walls 18 and 19 of the coil form 52. Horizontal deflection coils 28 and vertical deflection coils 29 are wound on the coil form 52 so as to be disposed in slots 55. Coil heads **28*b* of the horizontal coil 28 are disposed in the coil head chamber 47 and 48, and coil heads 29*b* of the vertical deflection coil 29 are disposed in the coil head chamber 45 and 46**.

Turn 28 which is associated with one of two horizontal deflection coils extends out of the plane of the figure at the coil head chamber 47, runs along a longitudinal slot, and into the plane of the paper at the coil head chambers 48. The other turns (not shown) of the horizontal deflection coils are correspondingly disposed in associated slot 55. Turn 29 which is associated with one of two vertical deflection coils extends out of the plane of the paper at the coil head chamber 45 runs along a slot 55, and reenters the plane of the paper at the coil head chamber 46. It is apparent from the figure that turns 28 and 29 are equidistant from a longitudinal central axis (not specifically shown) of the coil form 12, and therefore, the completed coils have substantially equal diameters.

Figure 2:
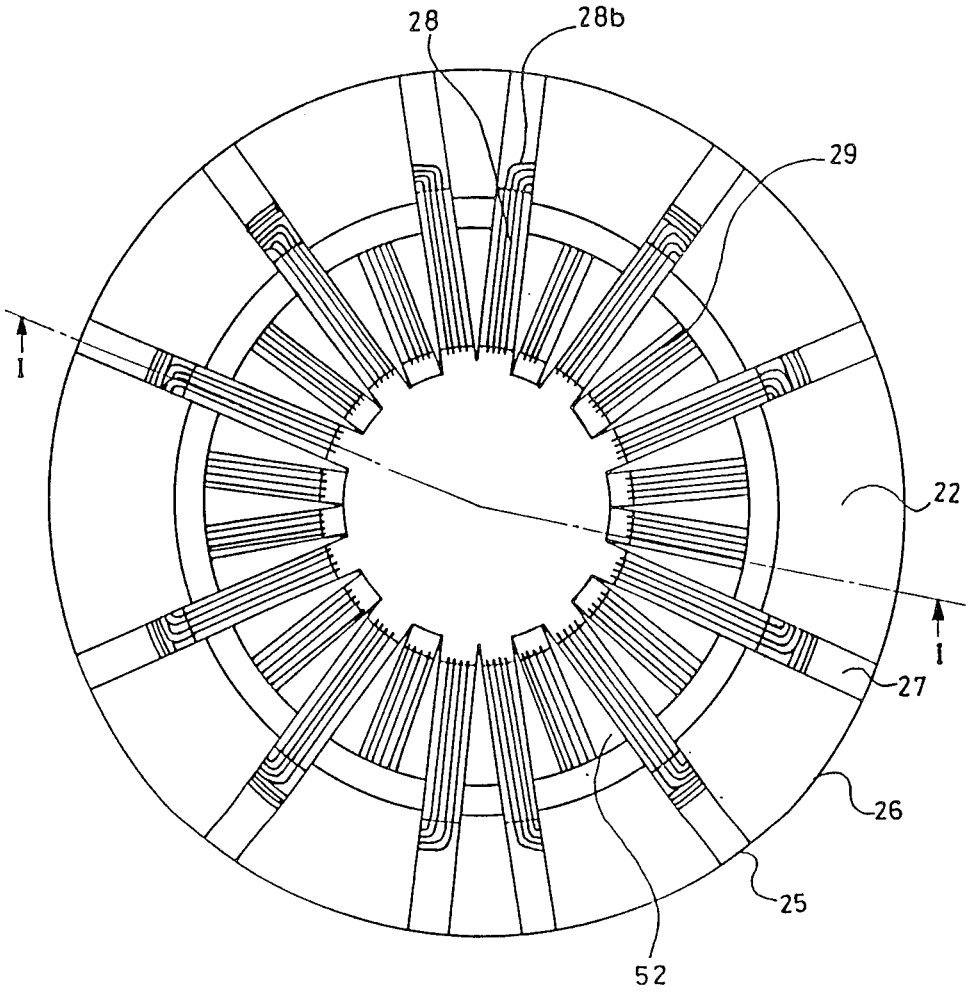
FIG. 2 is a front plan view of the coil form of the embodiment.
Figure 3A:
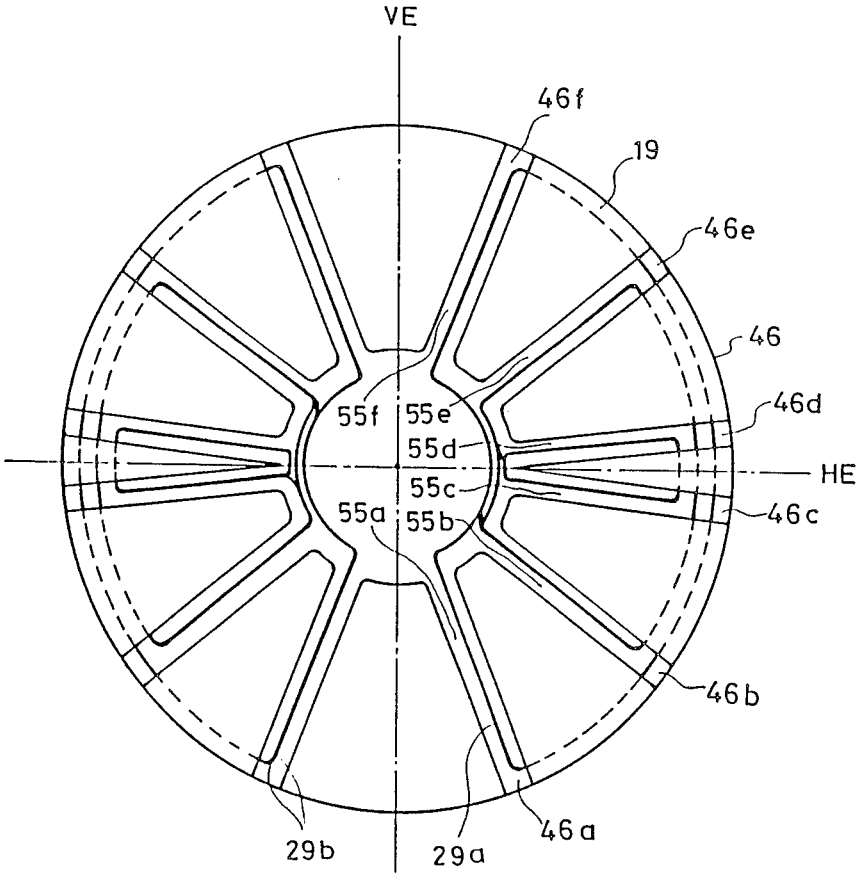
FIG. 3*a* and FIG. 3*b* are front plan views of the coil form of the embodiment.
Figure 3B:
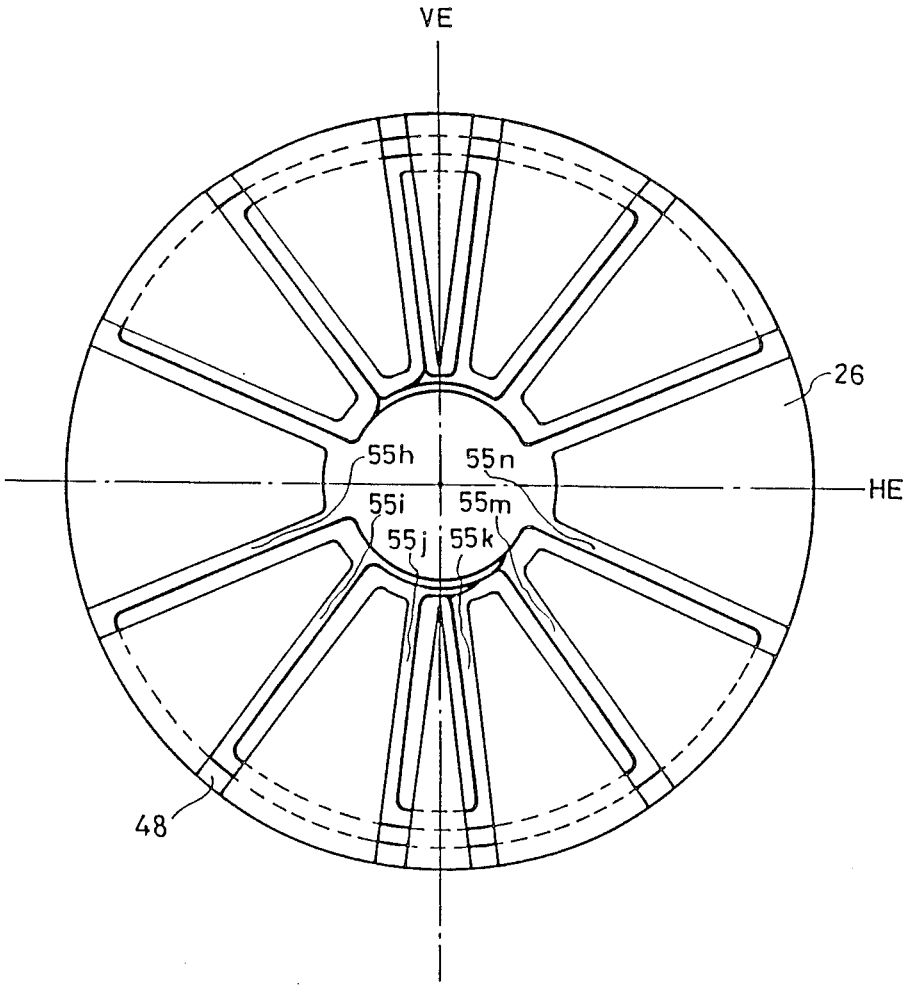

FIG. 2 shows a frontal view of the coil form 52 and the front bobbin 22, and shows the cross-section of section planes I and I along which the cross-sectional representation of FIG. 1 is presented. Front wall 26 is shown to be discontinuous so as to permit communication between coil head chambers 48 and the slots 55. As can be seen from FIG. 1, predetermined ones of slots 55 which contain turns of wires to the coil head chamber 48 run into the coil head chamber 48, and therefore do not communicate with the coil head chamber 46. However, other ones of slots 55 which carry wires to the coil head chamber 46, such as turn 29 in FIG. 1, communicate with the coil head chambers 46. The coil head chamber 46 and 48 are separated from each other by a partition wall 19 and 25. Partition wall 25 is visible through some of slots 27 in FIG. 2.

FIG. **3*a* shows a front plan view of the coil form 52. The vertical deflection coils 29 are wound prior to connection of the front bobbin 22 and the rear bobbin 21 to the coil form 52**.

A coil turn **29*a* lying in slot 55*a* runs to a point 46*a* in front coil head chamber 46. At this point, the coil winding wire would be bent to the right at substantially a right angle, so as to be disposed in chamber 46 for approximately a semi-circle. The winding would enter slot 55*f* at a point 46*f*. In this example, the coil wire 29*a* would run to the end of slot 55*f* and into rear coil head chamber 45, wherein it is returned to the rear of slot 55*a*. Similarly, a corresponding winding can be formed by placing the wire in a slot 55*b* to a point 46*b*, at which point the wire is turned to the right so as to follow a semi-circle through coil head chamber 46 to a point 46*e* where the wire would enter slot 55*e*. The wire is returned to slot 55*b* by means of rear coil head chamber 45. Additional corresponding windings are disposed in slots 55*c* and 55*d*. All such windings are wound in series, and thereby form a vertical deflection coil. A second vertical deflection coil 29*b* is symmetrical to the coil 29*a* just described with respect to an axial plane VE which extends in the vertical direction. Both such symmetrical coils 29*a* and 29*b*** can be advantageously connected in series or parallel to form the set of coils for the vertical deflection.

After winding the vertical deflection coil 29, the front bobbin 22 and the rear bobbin 21 are mounted on the front portion and the rear portion of the coil form 52, respectively. Subsequently the horizontal deflection coils 28 are wound in a manner similar to that described hereinabove.

FIG. **3*b* shows a front plan view of the front bobbin 22**.

The horizontal deflection coils **28*a* and 28*b* are disposed on the coil form 52 so as to be orthogonal to the vertical deflection coils and symmetrical with respect to an axial plane HE which extends in the direction of the horizontal deflection. One winding of the coil would lie in slots 55*h* and 55*n*. Further, such windings would lie in slots 55*i* and 55*m*, 55*j* and 55*k*. In practice, the horizontal and vertical deflection coils are wound so as to be interleaved. The slots 55*a*, 55*b*, 55*e*, 55*f*, 55*h*, 55*i*, 55*m* and 55*n* disposed between the axial planes VE and HE are alternatingly wound with horizontal and vertical deflection turns. Only those slots which are disposed adjacent to the axial planes VE and HE contain windings of coils associated with only one direction of deflection. Thus, the slots 55*j* and 55*k* adjacent to axial plane VE contain only horizontal deflection coil windings; and the slots 55*c* and 55*d*** adjacent to horizontal axial plane HE contain only vertical deflection coil windings.

Figure 4:
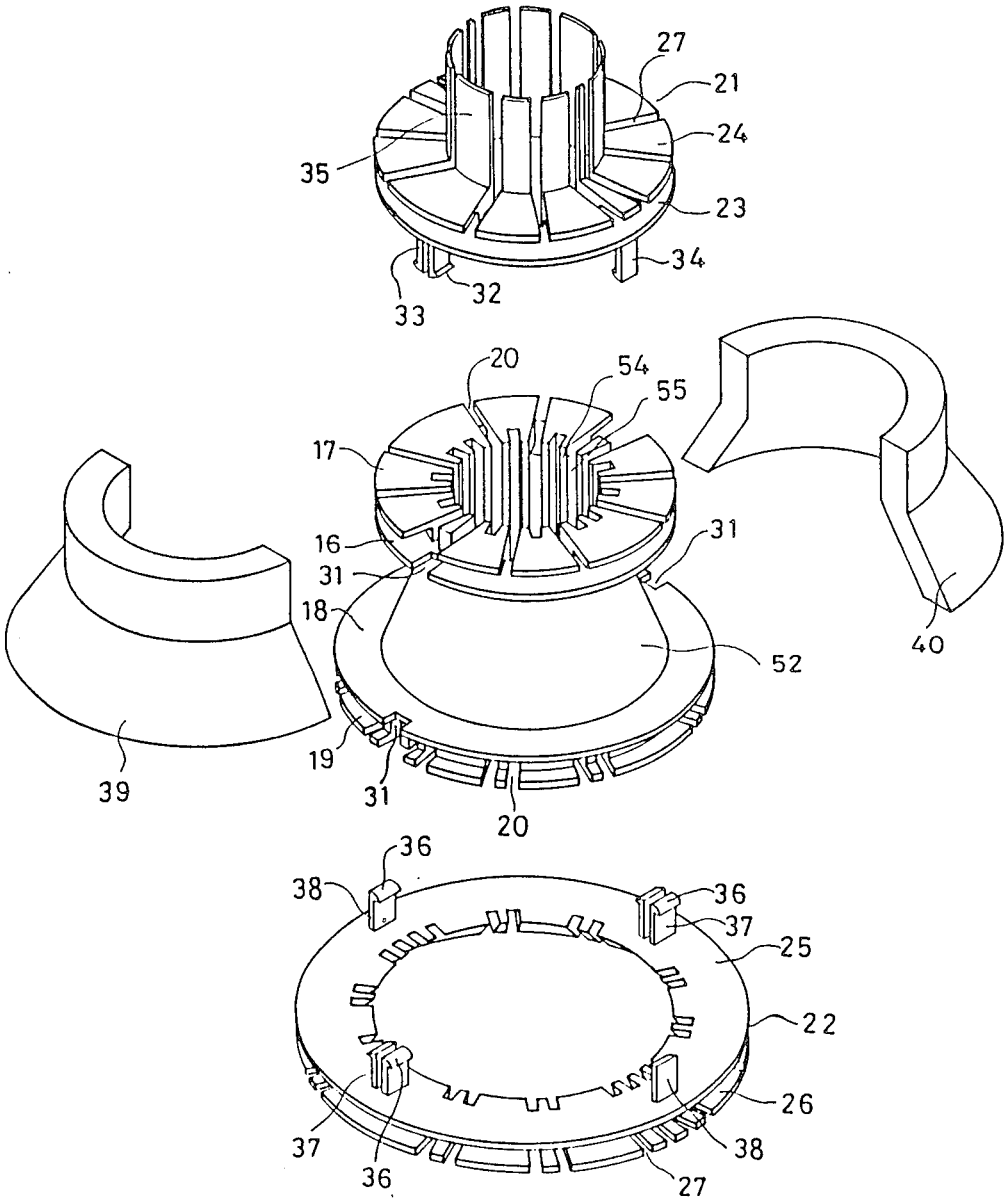
FIG. 4 is a perspective view of the rear portion of the embodiment.
Figure 5:
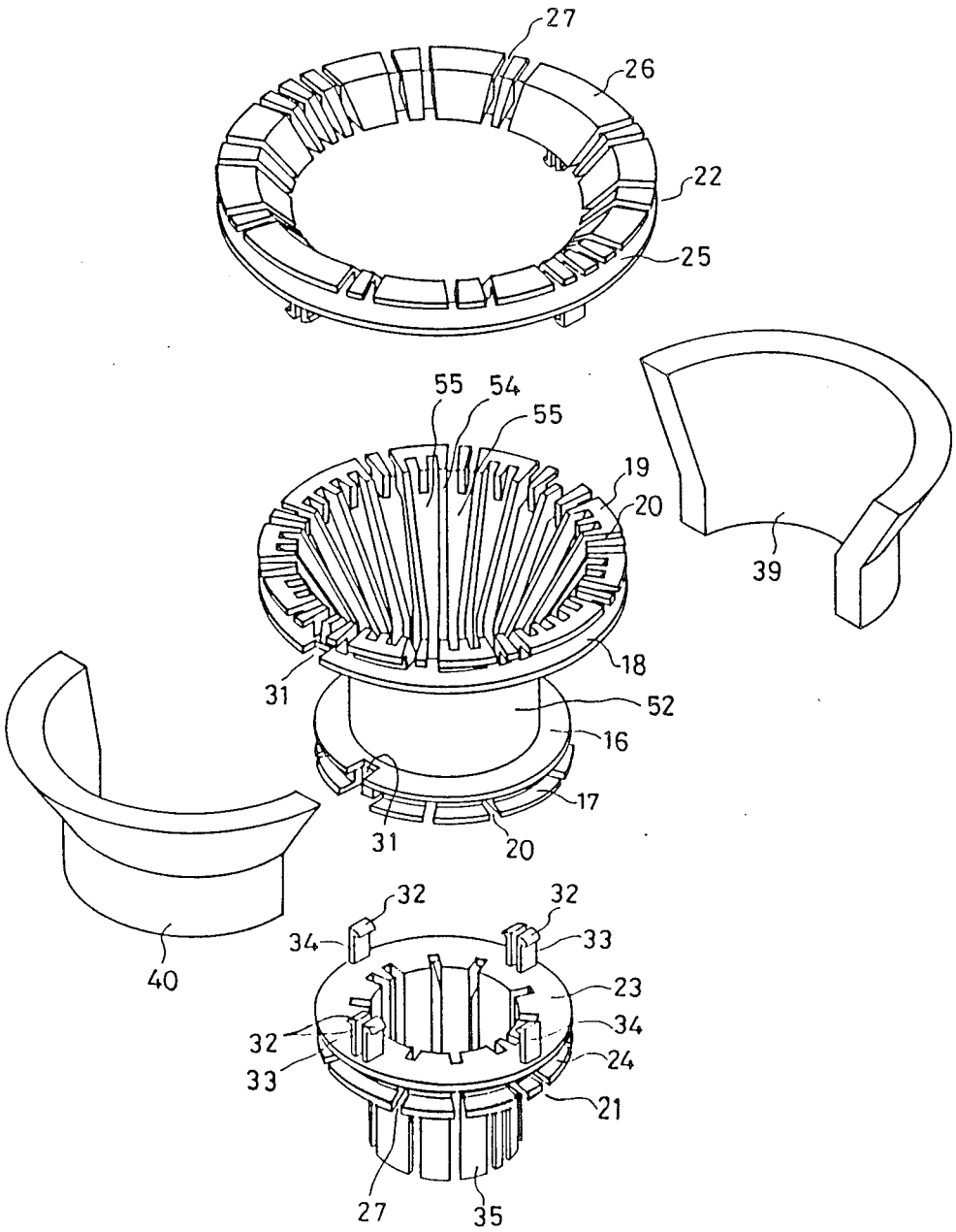
FIG. 5 is a perspective view of the front portion of the embodiment.
Figure 6:
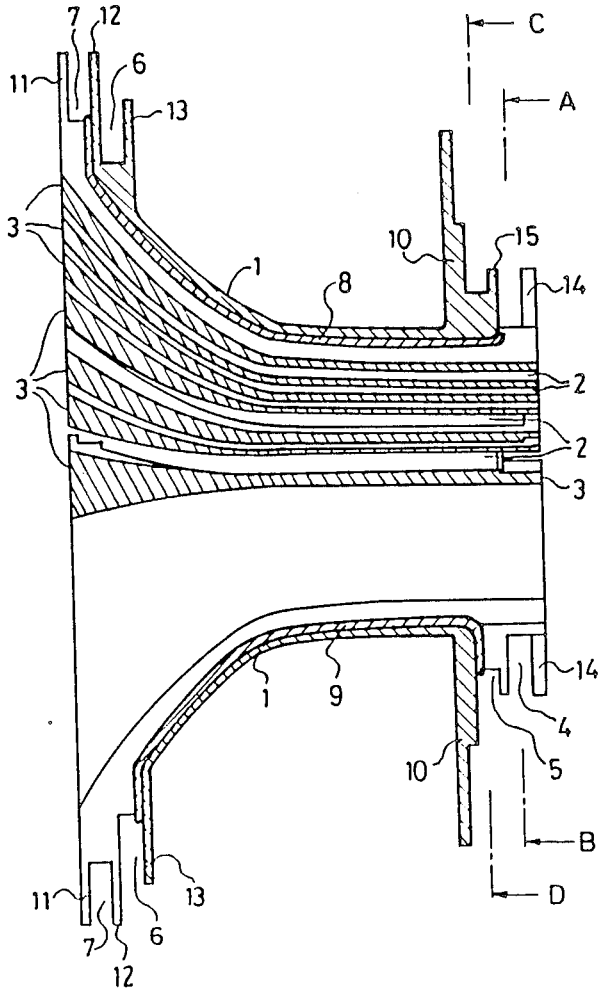
FIG. 6 (Prior Art)
FIG. 6 is the cross-sectional representation of the coil form in the prior art.
Figure 7:
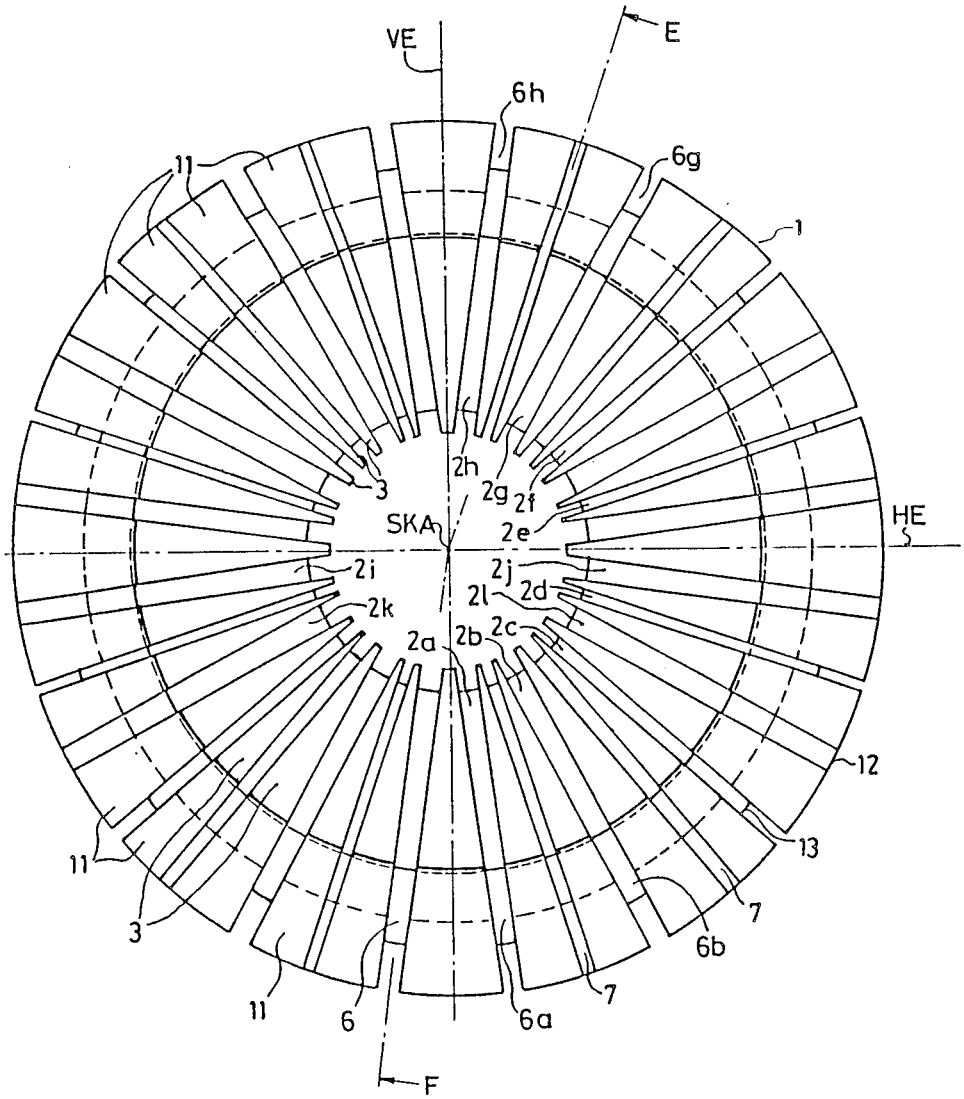
FIG.7 (Prior Art)
FIG. 7 is the front plan view of the coil form in the prior art.
Figure 8:
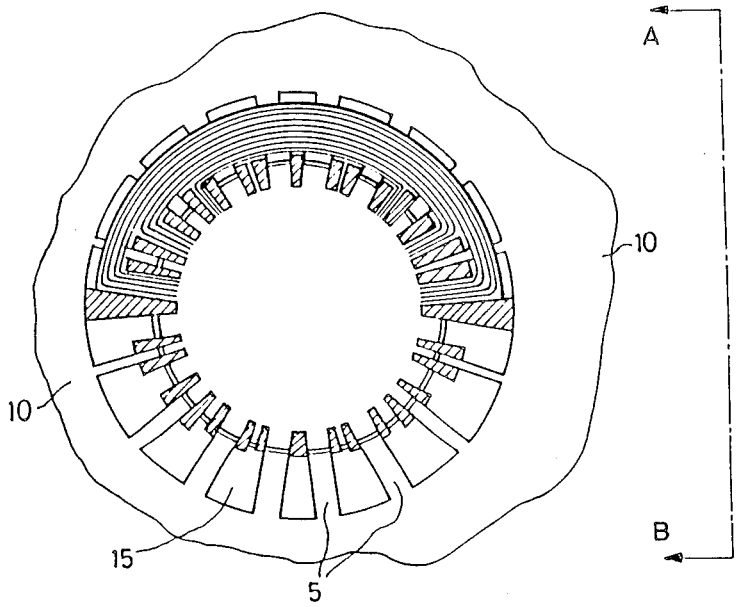
FIG.8 (Prior Art)
FIG. 8 is the cross-sectional representation of the rear portion of the coil form showing horizontal deflection coils disposed in the rear coil head chambers in the prior art.
Figure 9:
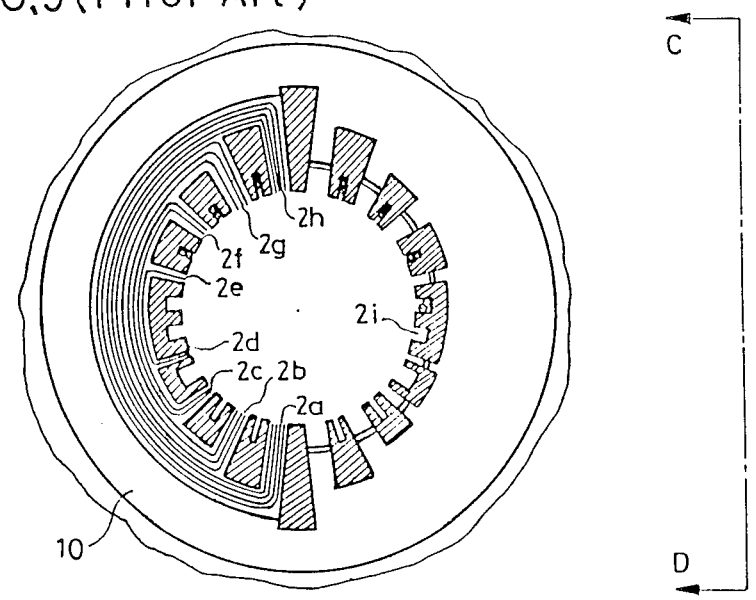
FIG.9 (Prior Art)
FIG. 9 is the cross-sectional representation of the rear portion of the coil form showing vertical deflection coils in the prior art.
Figure 10:
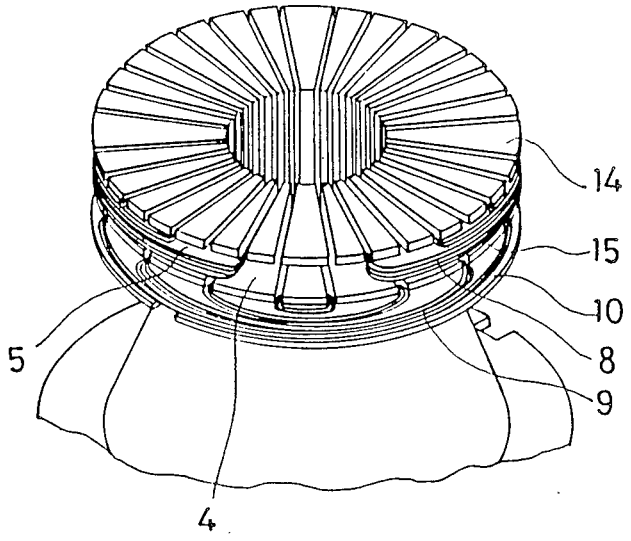
FIG. 10 (Prior Art)
FIG. 10 is the perspective view of the rear portion of the coil form in the prior art.
Figure 11:
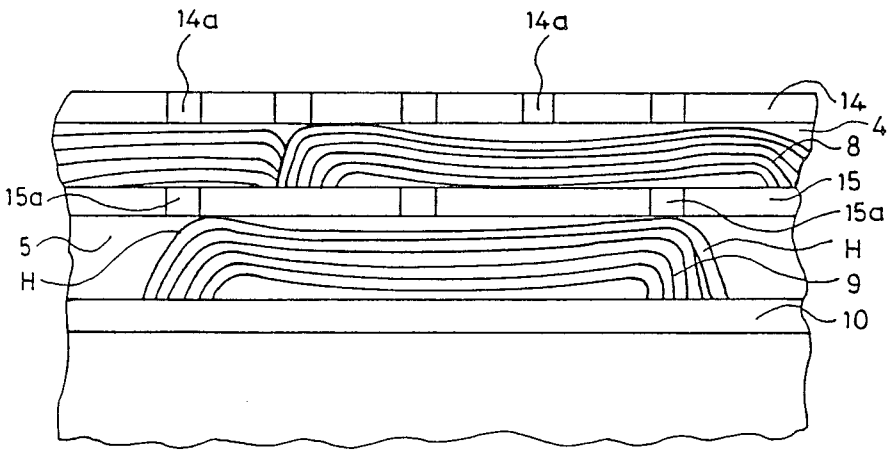
FIG. 11 (Prior Art)
FIG. 11 is the side view of the rear portion of the coil form as shown in FIG. 10.

FIGS. 4 and 5 show detailed perspective views of the coil form 52, the rear bobbin 21 and the front bobbin 22, in an embodiment of present invention. FIG. 4 especially shows rear portion of the coil form 52 and FIG. 5 especially shows front portion thereof. The wall 25 of the front bobbin 22 is provided with pairs of fasteners 36 and 38 on an outer surface. The fasteners 39 are formed by two fastening members and the fasteners 38 are formed by one fastening member. Respective fasteners 37 and 38 are provided with flukes 36 on the tops.

When the front bobbin 22 is mounted on the front portion FP of the coil form 52, the fasteners 37 are inserted in slots 31 provided on the wall 18, and the flukes 36 are caught thereby. The fasteners 38 also are caught by the edges of the wall 18.

In a manner similar to that described hereinabove, the wall 23 of the rear bobbin 21 is also provided with pairs of fasteners 33 and 34 on an outer surface as shown in FIG. 5. Flukes 32 of the fasteners 33 and 34 are also caught by edges of the wall 16 when the rear bobbin 21 is mounted to the coil form 52.

The fasteners 33, 34, 37 and 38 can be provided on the walls 17 and 19 and the slots 30 are disposed on the walls 23 and 25 in this case.

The rear bobbin 21 and the front bobbin 22 can be adhered to the coil form 52 by a bond instead of use of the above-mentioned fasteners 33, 34, 37 and 38.

After winding of both the horizontal and the vertical deflection coil, the deflecting yoke is completed by mounting of cores 39 and 40 on the coil form 52.

The rear bobbin 23, as shown in FIG. 4, is provided with a plurality of strips 35 which protrude from the slots 55 at the rear portion RP on an outer surface of the wall 24 and are disposed on a circle with gaps between each other, wherein the diameter thereof is substantially identical with that of the neck of a CRT, the plates 35 are fastened around the neck of the CRT by a known ring shape belt (not shown in the drawing).

What is claimed is:

1. A deflecting yoke comprising:

a coil form for holding a horizontal deflection coil and a vertical deflection coil in plural slots extended along the inside of said coil form shaped so as to flare outwardly with respect to a direction along a central longitudinal axis, and having coil head chambers for winding one of the horizontal deflection coil and the vertical deflection coil, which are formed by walls disposed on both end parts of said slots, a rear bobbin connected to said coil form by connecting means for winding one of the horizontal deflection coil and the vertical deflection coil in a coil head chamber formed by two walls disposed around said rear bobbin, and a front bobbin connected to said coil form by connecting means for winding one of the horizontal deflection coil and the vertical deflection coil in a coil head chamber formed by two walls disposed around said front bobbin.

2. A deflecting yoke in accordance with claim 1, wherein said walls of the rear bobbin or the front bobbin, which are adjacent to the walls of the coil form, are disk shaped.

3. A deflecting yoke in accordance with claim 1, wherein said rear bobbin and said front bobbin are bonded to the coil form by an adhesive.

4. A deflecting yoke comprising:

a coil form for holding a horizontal deflection coil and a vertical deflection coil in plural slots extended along the inside of said coil form shaped so as to flare outwardly with respect to a direction along a central longitudinal axis, and having coil head chambers for winding one of the horizontal deflection coil and the vertical deflection coil, which are formed by walls disposed on both end parts of said slots, a rear bobbin fastened to said coil form by fastening member for winding one of the horizontal deflection coil and the vertical deflection coil in a coil head chamber formed by two walls disposed around said rear bobbin, and a front bobbin fastened to said coil form by fastening member for winding one of the horizontal deflection coil and the vertical deflection coil in a coil head chamber formed by two walls disposed around said front bobbin.

5. A deflecting yoke in accordance with claim 4, wherein said fastening members are provided on the walls of the coil form and the walls of the rear bobbin and the front bobbin are provided with means for catching said fastening members of the coil form.

6. A deflecting yoke in accordance with claim 4, wherein said fastening members are formed to catch the outer edge of the walls of the rear bobbin and the front bobbin.

* * * * *